US005951328A

United States Patent [19]

Roper, Jr.

[11] Patent Number: 5,951,328

[45] Date of Patent: Sep. 14, 1999

[54] BLADE-TO-FERRULE FUSE ADAPTER

[76] Inventor: Arthur L. Roper, Jr., 40 S. 106 St. East Ave., Tulsa, Okla. 74128

[21] Appl. No.: 09/036,408

[22] Filed: Mar. 5, 1998

[51] Int. Cl.[6] ..... H01R 13/66

[52] U.S. Cl. ..... 439/621

[58] Field of Search ..... 439/621, 622; 337/186, 112, 113, 198

[56] References Cited

U.S. PATENT DOCUMENTS 5,085,600 2/1992 Damron ..... 439/621

*Primary Examiner*—Gary F. Paumen

*Assistant Examiner*—Truc T.T. Nguyen

[57] ABSTRACT

A fuse adapter is provided including an insulated housing and a pair of conductive caps mounted on the housing and releasably secured within a cylindrical-type fuse outlet. Also included is a pair of female contacts mounted on the housing and connected to the caps for releasably receiving a pair of planar contacts strips of a planar-type fuse thus allowing communication between the planar-type fuse and the cylindrical-type fuse outlet.

10 Claims, 2 Drawing Sheets

BLADE-TO-FERRULE FUSE ADAPTER

BACKGROUND OF THE INVENTION

1. Field of the Invention

The present invention relates to fuses and more particularly pertains to a new fuse adapter for allowing communication between a cylindrical-type fuse outlet and a planar-type fuse.

2. Description of the Prior Art

The use of fuses is known in the prior art. More specifically, fuses heretofore devised and utilized are known to consist basically of familiar, expected and obvious structural configurations, notwithstanding the myriad of designs encompassed by the crowded prior art which have been developed for the fulfillment of countless objectives and requirements.

Known prior art fuses include U.S. Pat. No. 4,391,485; U.S. Pat. No. 5,085,600; U.S. Pat. No. 4,830,631; U.S. Pat. No. 4,950,195; U.S. Pat. Des. 356,998; and U.S. Pat. No. 5,444,428.

In these respects, the fuse adapter according to the present invention substantially departs from the conventional concepts and designs of the prior art, and in so doing provides an apparatus primarily developed for the purpose of allowing communication between a cylindrical-type fuse outlet and a planar-type fuse.

SUMMARY OF THE INVENTION

In view of the foregoing disadvantages inherent in the known types of fuses now present in the prior art, the present invention provides a new fuse adapter construction wherein the same can be utilized for allowing communication between a cylindrical-type fuse outlet and a planar-type fuse.

The general purpose of the present invention, which will be described subsequently in greater detail, is to provide a new fuse adapter apparatus and method which has many of the advantages of the fuses mentioned heretofore and many novel features that result in a new fuse adapter which is not anticipated, rendered obvious, suggested, or even implied by any of the prior art fuses, either alone or in any combination thereof.

To attain this, the present invention generally comprises a hollow plastic housing having a cylindrical portion and a rectangular portion. The rectangular portion is integrally coupled to a central extent of the cylindrical portion and extends therefrom in coplanar relationship therewith. As shown in the Figures, the rectangular portion extends from the cylindrical portion a distance twice that of a diameter of the cylindrical portion. Further, the rectangular portion has a length about ½ that of the cylindrical portion and a thickness equal to the diameter of the cylindrical portion. Next provided is a pair of conductive caps each having a circular face and a cylindrical side wall integrally coupled to a periphery of the circular face for defining an open end. Each of the caps are thus adapted for receiving an end of the cylindrical portion of the housing. As shown in FIG. 2, the caps are releasably secured within a cylindrical-type fuse outlet. A pair of female contacts are provided each including a conductive strip mounted within an outboard face of the rectangular portion of the housing. Each conductive strip is bent to define a planar top face and a pair of resilient cylindrical lower portions. By this structure, a sleeve is defined having an open end positioned flush with the outboard face of the rectangular portion of the housing. Each of the female contacts is electrically connected to an associated one of the conductive caps via a wire situated within the housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new fuse adapter apparatus and method which has many of the advantages of the fuses mentioned heretofore and many novel features that result in a new fuse adapter which is not anticipated, rendered obvious, suggested, or even implied by any of the prior art fuses, either alone or in any combination thereof.

It is another object of the present invention to provide a new fuse adapter which may be easily and efficiently manufactured and marketed.

It is a further object of the present invention to provide a new fuse adapter which is of a durable and reliable construction.

An even further object of the present invention is to provide a new fuse adapter which is susceptible of a low cost of manufacture with regard to both materials and labor, and which accordingly is then susceptible of low prices of sale to the consuming public, thereby making such fuse adapter economically available to the buying public.

Still yet another object of the present invention is to provide a new fuse adapter which provides in the apparatuses and methods of the prior art some of the advantages thereof, while simultaneously overcoming some of the disadvantages normally associated therewith.

Still another object of the present invention is to provide a new fuse adapter for allowing communication between a cylindrical-type fuse outlet and a planar-type fuse.

Even still another object of the present invention is to provide a new fuse adapter that includes an insulated housing and a pair of conductive caps mounted on the housing and releasably secured within a cylindrical-type fuse outlet. Also included is a pair of female contacts mounted on the housing and connected to the caps for releasably receiving a pair of planar contacts strips of a planar-type fuse thus allowing communication between the planar-type fuse and the cylindrical-type fuse outlet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
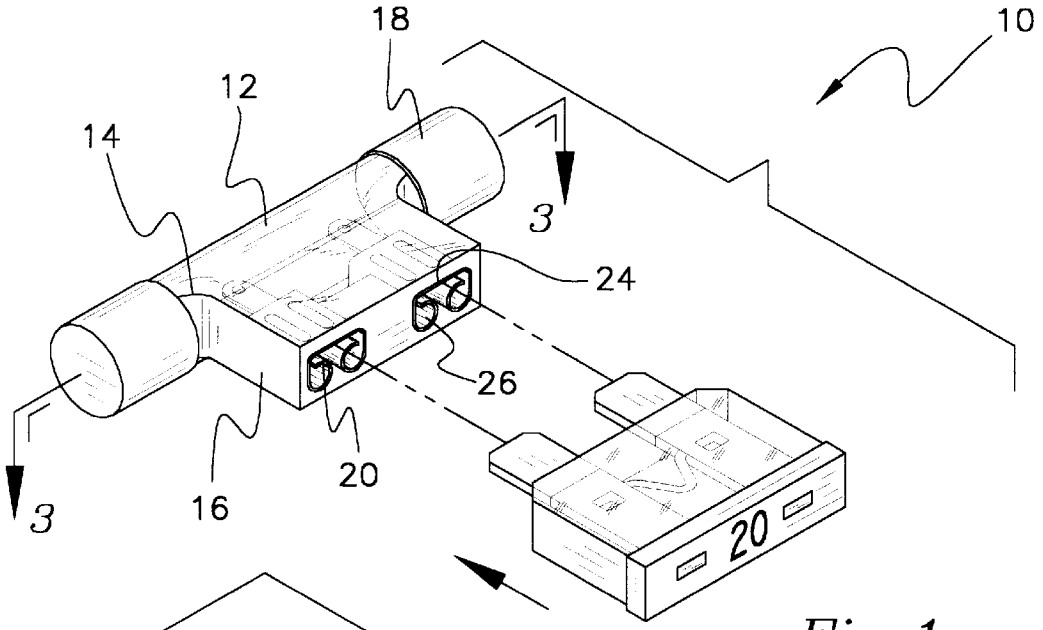
FIG. 1 is an exploded view of a new fuse adapter according to the present invention.

With reference now to the drawings, and in particular to FIGS. 1 through 6 thereof, a new fuse adapter embodying the principles and concepts of the present invention and generally designated by the reference numeral 10 will be described.

Figure 3:
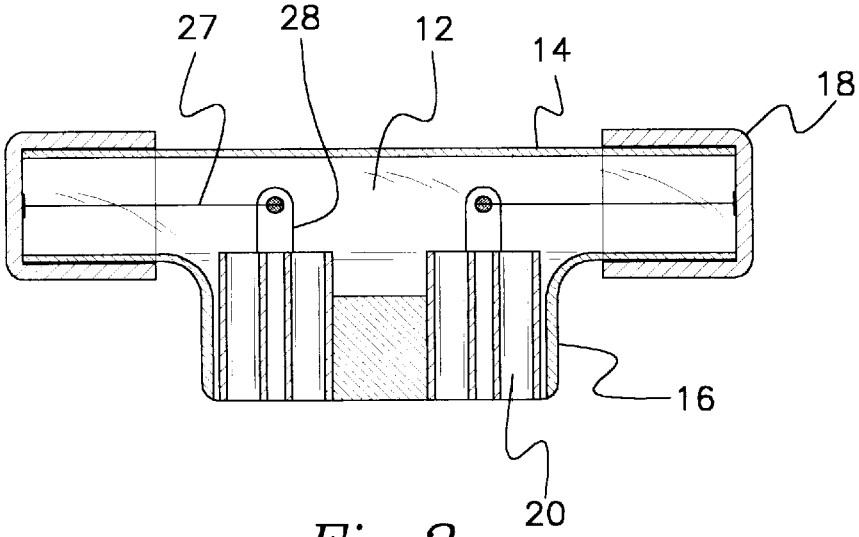
FIG. 3 is a top cross-sectional view of the present invention taken along line 3—3 shown in FIG. 1.

The present invention, designated as numeral 10, includes a hollow plastic housing 12 having a cylindrical portion 14 and a rectangular portion 16. For reasons that will become apparent, the cylindrical portion is hollow while the rectangular portion is essentially solid, as shown in FIG. 3. The rectangular portion is integrally coupled to a central extent of the cylindrical portion and extends therefrom in coplanar relationship therewith.

As shown in the Figures, the rectangular portion extends from the cylindrical portion a distance twice that of a diameter of the cylindrical portion. Further, the rectangular portion has a length about ½ that of the cylindrical portion and a thickness equal to the diameter of the cylindrical portion.

Figure 2:
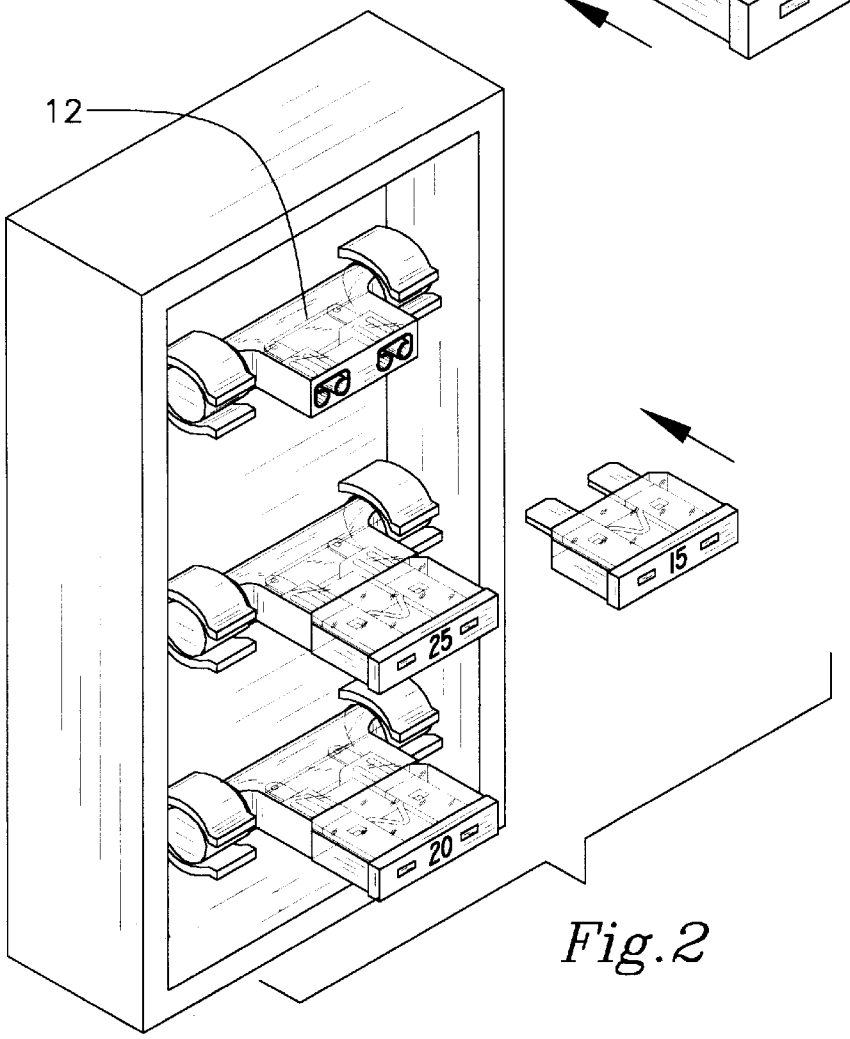
FIG. 2 is an exploded view of the cylindrical-type fuse outlet, planar-type fuse and the present invention.

Next provided is a pair of conductive caps 18 each having a circular face and a cylindrical side wall integrally coupled to a periphery of the circular face for defining an open end. Each of the caps are thus adapted for receiving an end of the cylindrical portion of the housing. As shown in FIG. 3, each cap extends approximately to the rectangular portion of the housing. As shown in FIG. 2, the caps are releasably secured within a cylindrical-type fuse outlet.

A pair of female contacts 20 are provided each including a unitary conductive strip 22 mounted within an outboard face of the rectangular portion of the housing. Each conductive strip is bent to define a planar top face 24 and a pair of resilient cylindrical lower portions 26. By this structure, a sleeve is defined having an open end positioned flush with the outboard face of the rectangular portion of the housing. Each of the female contacts is electrically connected to an associated one of the conductive caps via a wire 27 situated within the housing. This connection is accomplished via a tab 28 integrally coupled to the top face of the strip and extending into the hollow cylindrical portion of the aperture. An end of the tab has an aperture formed therein for connecting with the wire.

Figure 4:
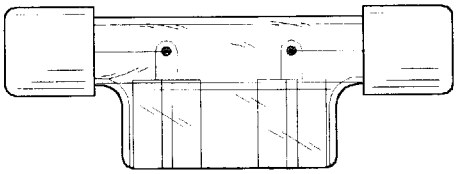
FIGS. 4–6 are top views of the housings of the present invention each constructed in various sizes.
Figure 5:
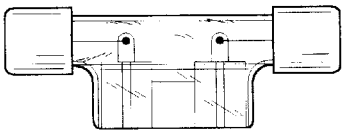
Figure 6:
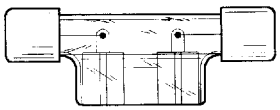

In use, the sleeves of the female contacts are adapted to releasably receive a pair of planar contacts strips of a planar-type fuse. As such, communication is afforded between the planar-type fuse and the cylindrical-type fuse outlet. As shown in FIGS. 4–6, the housing is preferably constructed in various sizes for accommodating planar-type fuses and cylindrical-type fuse outlets of various sizes. Such sizes preferably include lengths of ⅝, ⅞, 1 1/16 and 1¼ inches.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A fuse adapter comprising, in combination:

a hollow plastic housing including a cylindrical portion and a rectangular portion integrally coupled to a central extent of the cylindrical portion and extending therefrom in coplanar relationship therewith, the rectangular portion extending from the cylindrical portion a distance twice that of a diameter of the cylindrical portion and having a length about ½ that of the cylindrical portion and a thickness equal to the diameter of the cylindrical portion;

a pair of conductive caps each having a circular face and a cylindrical side wall integrally coupled to a periphery of the circular face for defining an open end for receiving an end of the cylindrical portion of the housing, wherein the caps are releasably secured within a cylindrical-type fuse outlet; and a pair of female contacts each including a conductive strip mounted within an outboard face of the rectangular portion of the housing, each conductive strip being bent to define a planar top face and a pair of resilient cylindrical lower portions for defining a sleeve having an open end positioned flush with the outboard face of the rectangular portion of the housing, each of the female contacts being electrically connected to an associated one of the conductive caps via a wire situated within the housing, wherein the sleeves of the female contacts are adapted to releasably receive a pair of planar contacts strips of a planar-type fuse for allowing communication between the planar-type fuse and the cylindrical-type fuse outlet.

2. A fuse adapter for mounting a planar-type fuse in a cartridge fuse receptacle, the planar-type fuse having a pair of planar contact strips and the cartridge fuse receptacle having a pair of spaced spring clips, the fuse adapter comprising:

an elongate insulated housing having a substantially cylindrical shape with cylindrical end portions, each cylindrical end portion being adapted for being releasably secured in a spring clamp of a cartridge fuse receptacle;

a pair of external contacts mounted on the cylindrical end portions of the housing adapted for creating an electrical connection with the spring clips of the cartridge fuse receptacle; and a pair of female contacts connected to the external contacts for releasably receiving a pair of planar contacts strips of a planar-type fuse for allowing communication between the planar-type fuse and the cartridge fuse receptacle when the external contacts are lodged in the spring clips of the cartridge fuse receptacle;

wherein the pair of female contacts are housed in a protrusion protruding perpendicularly from the substantially cylindrical elongate housing.

3. A fuse adapter as set forth in claim 2 wherein the protrusion has a substantially rectangular shape.

4. A fuse adapter as set forth in claim 3 wherein the substantially rectangular protrusion is integrally coupled to a central extent of the substantially cylindrical housing and extends therefrom in coplanar relationship therewith.

5. A fuse adapter as set forth in claim 3 wherein the substantially rectangular protrusion extends from the substantially cylindrical housing a distance twice that of a diameter of the substantially cylindrical housing.

6. A fuse adapter as set forth in claim 3 wherein the substantially rectangular protrusion has a length about ½ that of the substantially cylindrical housing and a thickness equal to a diameter of the substantially cylindrical housing.

7. A fuse adapter as set forth in claim 2 wherein the protrusion has a length in a longitudinal direction of the elongate housing and a width in a direction transverse to the length of the protrusion, and wherein the length and width of the protrusion are substantially the same as a conventional planar-type fuse when the planar contact strips of a planar-type fuse are engaged with the female contacts.

8. A fuse adapter comprising:

an insulated housing;

a pair of external contacts mounted on the housing and releasably secured within a cylindrical-type fuse outlet; and a pair of female contacts mounted on the housing and connected to the external contacts for releasably receiving a pair of planar contacts strips of a planar-type fuse for allowing communication between the planar-type fuse and the cylindrical-type fuse outlet;

wherein the housing includes a cylindrical portion and a rectangular portion; and wherein the rectangular portion is integrally coupled to a central extent of the cylindrical portion and extending therefrom in coplanar relationship therewith.

9. A fuse adapter as set forth in claim 8 wherein the rectangular portion extends from the cylindrical portion a distance twice that of a diameter of the cylindrical portion.

10. A fuse adapter as set forth in claim 8 wherein the rectangular portion has a length about ½ that of the cylindrical portion and a thickness equal to a diameter of the cylindrical portion.

* * * * *